United States Patent [19]

Bailey et al.

[11] 4,403,531

[45] Sep. 13, 1983

[54] PRESET TORQUE WRENCH

[76] Inventors: Roy E. Bailey, Rte. #2, Box 100, Clifton, Tenn. 38425; Ben J. Bailey, 901 Michigan St., Brighton, Mich. 48116

[21] Appl. No.: 242,626

[22] Filed: Mar. 11, 1981

[51] Int. Cl.[3] ..... B25B 23/142

[52] U.S. Cl. ..... 81/483

[58] Field of Search ..... 81/478, 483

[56] References Cited

U.S. PATENT DOCUMENTS

| | | | |
|---|---|---|---|
| Re. 25,547 | 4/1964 | Skidmore | 81/483 |
| 2,393,681 | 1/1946 | Hartley | 81/483 |
| 3,272,002 | 9/1966 | Dickman | 81/483 |
| 3,577,815 | 5/1971 | Bergquist | 81/483 |
| 3,599,515 | 8/1971 | Grabovac | 81/483 |
| 4,316,397 | 2/1982 | Skidmore et al. | 81/483 |

*Primary Examiner*—James L. Jones, Jr.
*Attorney, Agent, or Firm*—James M. Deimen

[57] ABSTRACT

The invention comprises improvements in manual preset torque wrenches that substantially improve the useful life of the wrench, the repeatable accuracy of the wrench, and substantially decrease the weight and manufacturing cost of the wrench.

The improvements include a free floating camming roller that moves from dual pockets with a rolling action substantially out of the pockets at the preset torque. In one embodiment the camming roller is centered within the wrench in the unactuated position between milled slots that comprise the pockets. In an alternate embodiment the pockets and camming roller are offset from the centerline of the wrench permitting a configuration that greatly reduces friction on the inside of the tubular wrench body. The reduction in friction and abrasion in the alternate embodiment permits a lightweight aluminum tube to be substituted for the body of the wrench thus significantly reducing the weight of the wrench.

The embodiments of the wrench permit the use of the same mechanism and same range of internal spring compression for a family of wrenches having several different ranges of torque settings. The maximum spring compression is identical for the maximum torque setting of each wrench of the family of wrenches. Thus, the load on critical internal wear parts is identical for all wrenches at their respective maximum torque settings. The load on the critical parts is well within the capacity of the parts, thereby minimizing inaccuracy due to the wear after extended use of any of the wrenches regardless of wrench size and maximum torque setting.

15 Claims, 10 Drawing Figures

PRESET TORQUE WRENCH

BACKGROUND OF THE INVENTION

The field of the invention pertains to hand operated mechanical torque wrenches and in particular to torque wrenches that may be preset to give a sudden audible and sensual signal when the present torque is reached. Such torque wrenches are commonly used on assembly lines by relatively unskilled workers to assure that threaded fasteners are repeatedly set to the proper torque.

The wrenches utilize a camming mechanism that suddenly releases when the preset torque is reached. The mechanisms generally fall into two categories, i.e., pivotally attached camming members and free floating camming members. Examples of pivotally attached camming members are illustrated by the pinned rollers of U.S. Pat. Nos. 2,918,834, 3,140,623, 3,165,014, 3,270,594, 3,577,815 and Re. 25,547. A ball retained within a socket as the camming member is also disclosed in U.S. Pat. Nos. 2,786,378 and 3,165,014 and British Pat. No. 966,947. Examples of the free floating camming members are illustrated by the rectangular and trapezoidal pawls of U.S. Pat. Nos. 2,743,638, 2,897,704 and 3,016,773.

The pinned roller wrenches are generally more complicated and therefore relatively expensive to manufacture and service. The ball in socket wrenches eliminate some of the complication, however, point contact and sliding movement over some portion of the camming action results in high surface stresses on the ball and engaging member. A short tool life occurs between of wear caused inaccuracy. Rebuild or replacement is then required. Similarly, the sharp corners on the free floating pawls are subject to wear with a resulting relatively short tool life because the accuracy of the wrench is greatly reduced. To counteract the wear problems, in many instances, wrenches of a larger size with a greater range than necessary for a particular application are purchased so that they may be set to a torque level below the maximum level for the wrench and thereby obviate the wear problem. Such an approach is obviously unnecessarily expensive.

SUMMARY OF THE INVENTION

The invention comprises improvements in manual preset torque wrenches that substantially improve the durability of the wrench, the repeatable accuracy of the wrench and substantially decrease the weight and manufacturing cost of the wrench.

The improvements include a free floating camming roller that moves from dual pockets with a sudden rolling action substantially out of the pockets upon the wrench reaching the preset torque. In one embodiment the camming roller is centered within the wrench in the unactuated position between milled slots that form the pockets. The round roller and milled slots eliminate the sharp pawl edges of some prior art wrenches. In an alternate embodiment the pockets and camming roller are offset from the centerline of the wrench permitting a configuration that greatly reduces the tendency to abrade the inside of the tubular wrench body. The reduction in abrasion permits a lightweight aluminum tube to be substituted for the body of the wrench thus significantly reducing the weight of the wrench.

The embodiments of the wrench permit the use of the same mechanism and same range of internal spring compression for a family of wrenches having several different ranges of torque settings. Thus, all the internal parts are interchangeable regardless of wrench size and capacity. The maximum spring compression is identical for the maximum torque setting of each wrench of the family of wrenches. Thus, the load on critical internal wear parts is identical for all wrenches at their respective maximum torque settings. The load on the critical wear parts is by design easily kept well within the capacity of the parts, thereby minimizing inaccuracy due to wear after extended use of any of the wrenches regardless of wrench size and maximum torque setting.

DESCRIPTION OF THE PREFERRED EMBODIMENTS

Figures 1, 2, 3, 4:
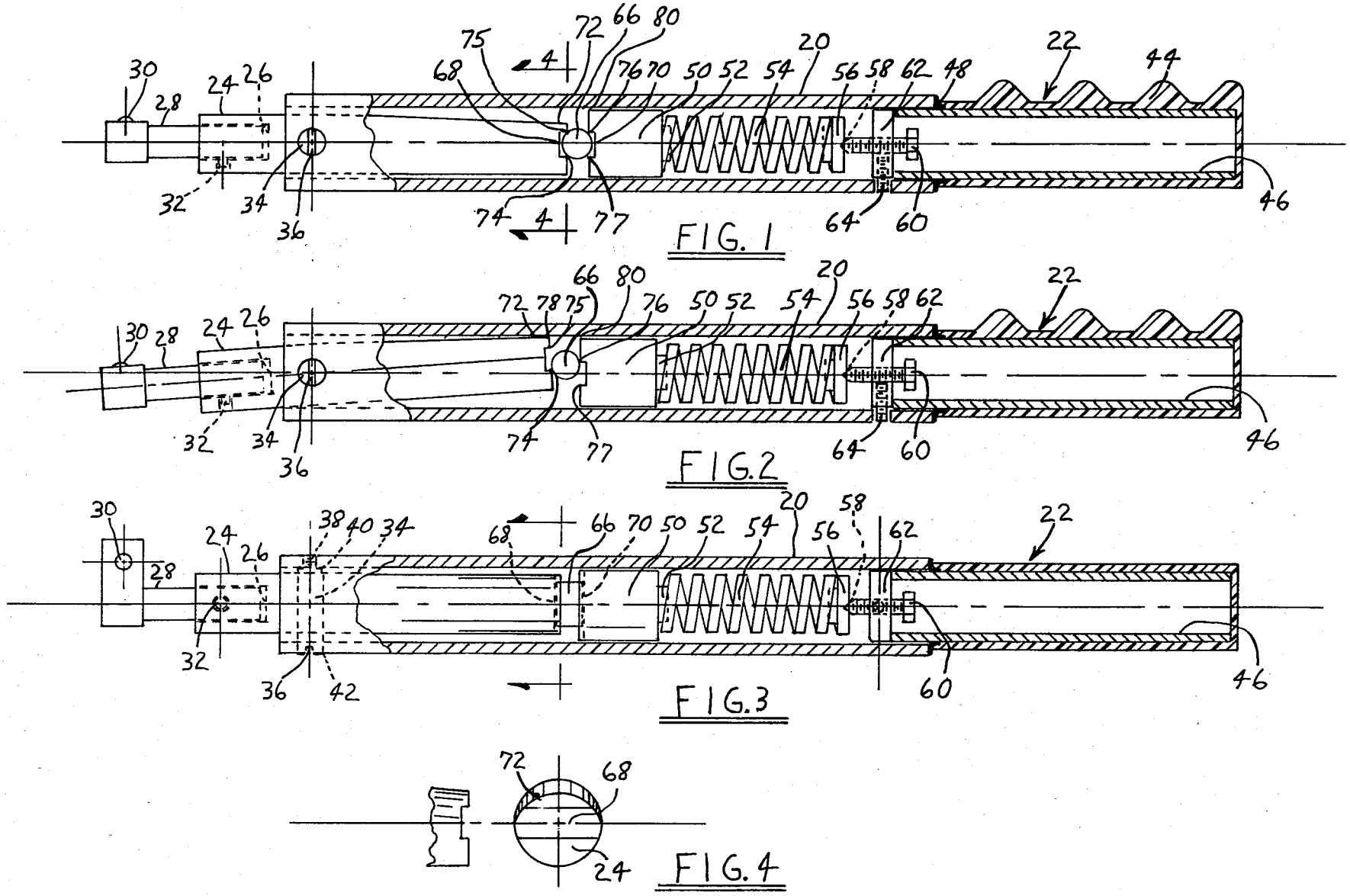
FIG. 1 is a cutaway longitudinal top view of the torque wrench.
FIG. 2 is a cutaway longitudinal top view of the torque wrench in actuated position.
FIG. 3 is a cutaway longitudinal side view of the torque wrench.
FIG. 4 is a cross-section taken along the line 4—4 of FIG. 1.

As illustrated in FIGS. 1 through 4 the wrench comprises a tubular main body 20, handle 22 and lever arm of click arm 24. Inserted into a socket 26 in the outside arm of the click arm 24 is an L-shaped torque adapter 28 having a ball detent 30 therein. A small spring loaded retainer pin 32 in the torque adapter 28 retains the adapter 28 in the socket 26 of the click arm 24. A variety of other torque adapters may be substituted for the adapter 28. The click arm 24 is pivotably retained in the end of the main body 20 by a round pin 34 slotted 36 for a screw driver at one end and threaded 38 at the other end. The threaded end 38 of the round pin 34 includes a shoulder 40 that binds against the inside wall of the main body 20. At the slotted end 36 the hole 42 in the main body is sized to provide a fit sufficiently tight to prevent lateral movement of the pin 34. The threaded round pin 34 may be easily removed permitting all the internal parts to be easily removed from the wrench for any needed servicing.

The handle 22 includes a rubber or plastic sleeve 44 fitted over a tube 46 in turn inserted into the end of the main body 20 and welded thereto at 48. The rubber or plastic sleeve 44 is molded into the shape of a handgrip as shown to provide the most comfortable location to grip the wrench. The user is thereby positively encouraged to grip the wrench at the correct location to apply the correct preset torque. The wrench is very comfortable to use repeatedly with the same accuracy and is unlikely to be inadvertently used inaccurately.

Within the main body 20 is a slideable member 50 having a shoulder and axial protrusion at 52 to center the engagement of a spring 54 thereon. At the other end of the spring 54 is a shouldered plug 56 in engagement therewith. The plug 56 includes an axial tapered socket 58 in turn engaging a taper point calibration bolt 60 threaded through a thrust plate 62. The thrust plate 62 abuts the end of the tube 46. The spring 54 urges the slideable member 50 toward the click arm 24 and in reaction the bolt 60 and thrust plate 62 against the tube 46.

The compression force on the spring 54 urging the slideable member 50 toward the click arm 24 is determined by adjusting the bolt 60 and once set is retained by tightening the threaded stud 64 in the thrust plate 62 against the bolt 60.

Separating the click arm 24 from the slideable member 50 is a transverse circular roller 66 retained between two transverse slots 68 in the click arm 24 and 70 in the slideable member 50 respectively. The axis of the roller 66 intersects the centerline of the tubular main body 20 and the slots 68 and 70 are symmetric about a diametral plane including the axis of the round pivot pin 34. The click arm 24 also includes a clearance taper 72 extending toward the slotted end thereof.

At torque levels below the preset torque determined by the compression of the spring 54, the roller 66 lies between the shallow slots 68 and 70 resting upon the slot edges 74, 75, 76 and 77 as shown in FIG. 1. Upon reaching the preset torque level, the slideable member 50 moves to the right compressing the spring 54 and the roller 66 rolls about slot edges 74 and 76 of slots 68 and 70 respectively. The movement occurs suddenly and the tapered 72 end of the click arm 24 strikes the inside of the tubular main body 20 as shown in FIG. 2 at 78 making a precise audible click and angular rotation for consistent free travel. The sudden pivotal release of the click arm 24 gives a sensual signal to the operator's hand.

The movement of the roller 66 out of the slots 68 and 70 is minimal and only sufficient to permit the clock arm 24 to move suddenly. As soon as the torque on the wrench is relieved the click arm 24, roller 66 and slideable member 50 return to the position in FIG. 1. Rolling line contact is maintained throughout the entire range of movement of the free floating roller 66. Thus, wear on the roller 66 and the slot edges 74 and 76 is minimized.

Preferably the roller 66 is constructed of 4140 alloy steel. The click arm 24, slideable member 50, spring cap 56 and thrust plate 62 are also constructed of 4140 alloy steel. The body 20 and handle 22 of the wrench may be constructed of 1026 steel or in the alternative disclosed in FIGS. 5 through 8 below of 6061T-6 aluminum alloy. The 4140 alloy steel roller 66 and other 4140 alloy steel parts are heat treated to a Rockwell C of 48–50 rather than case hardened. Experiment has shown that the alloy roller is not as subject to wear or spalling as with case hardened low carbon steel wear parts.

The wrench of FIGS. 1 through 4 utilizes a free floating roller 66 to eliminate sliding friction thereby improving the accuracy and repeatability of the preset torque level. However, the centerline located roller transmits the torque couple of the wrench body 20 and click arm 24 to the slideable member 50 causing the slideable member to cock slightly in the sliding clearance within the inside of the tubular main body 20. This slight cocking tends to abrade the inside of the body at 80 (FIG. 2) and has heretofore required the use of a steel tube for the main body 20 to prevent excessive wear and friction.

FIGS. 5 through 8 illustrate an alternative embodiment that obviates the body internal wear problem thereby permitting the use of an aluminum wrench body 120 and handle 122. Aside from the aluminum body 120 and handle 122 welded thereto at 148, the external appearance and use of the wrench is the same. The click arm 124 includes a socket 126 to accept a torque adapter 128 extending therefrom and a pivot pin 134 retains the click arm 124 in the body 120. Within the wrench body 120 is a thrust plate 162 and calibration bolt 160 retained in position against the handle 122 by the action of the spring 154 and shouldered plug 156. A locking threaded stud 164 retains the preset calibration setting of the bolt 160.

Figure 5:
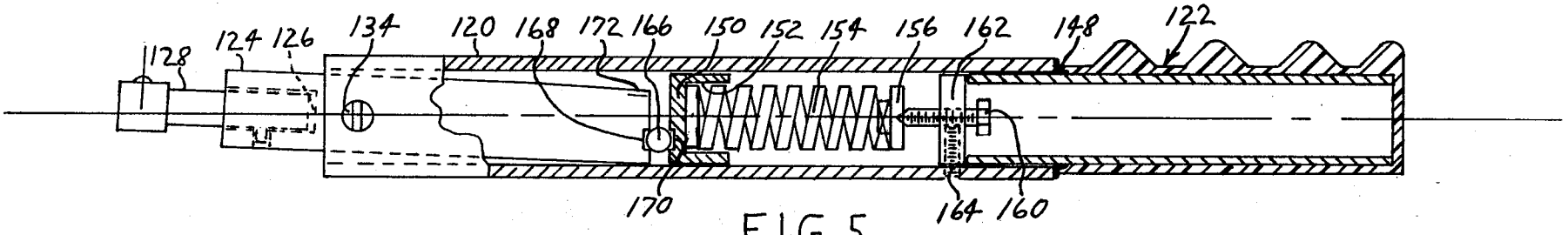
FIG. 5 is a cutaway longitudinal top view of an alternative form of the torque wrench.
Figure 6:
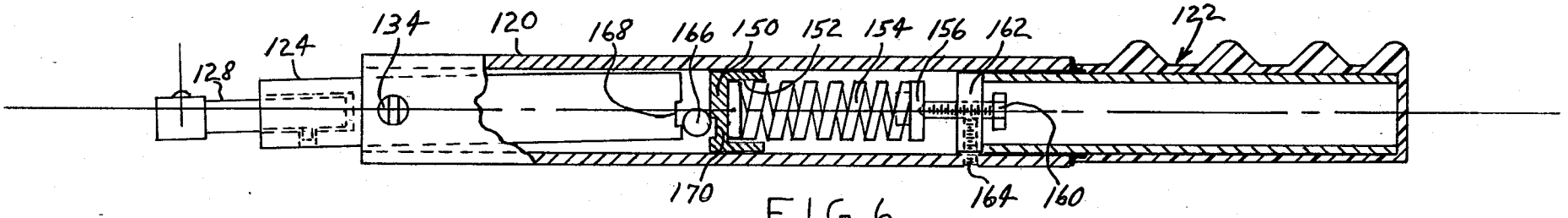
FIG. 6 is a cutaway longitudinal top view of the torque wrench of FIG. 5 in actuated position.
Figure 7:
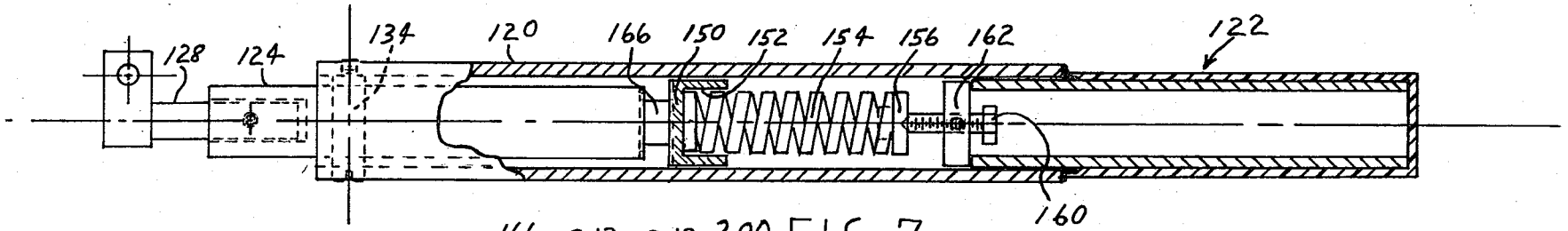
FIG. 7 is a cutaway longitudinal side view of the torque wrench of FIG. 5.

In this embodiment the sliding member 150 is cup shaped at 152 to retain the spring therein and, more importantly, to bring the engagement of the spring 154 with the sliding member 150 axially close to the roller end of the sliding member. As best shown in FIG. 5 the camming roller 166 and milled slots or pockets 168 and 170 in the click arm 124 and sliding member 150 respectively, are offset radially from the axis of the wrench diametrically opposite the tapered portion 172 of the click arm. The axis of the roller 166 and slots 168 and 170, however, remain parallel to the diametral plane that includes the axis of the pivot pin 134.

Figure 8:
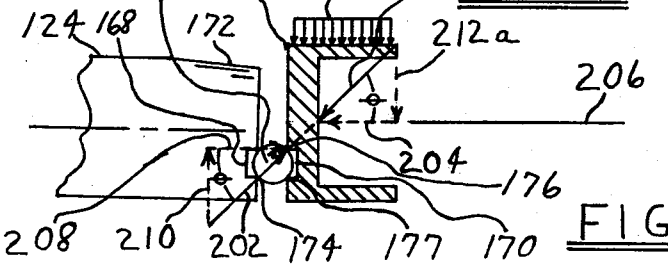
FIG. 8 is a detail of the geometric relationships in the torque wrench of FIG. 5.

Referring to FIG. 8, the spring 154 urges the sliding member 150 leftward as shown by arrow 204 with a force determined by the spring rate of the spring and the setting of the calibration bolt 160. The spring force 204 acts along the axis 206 of the wrench for a fully seated spring as shown. The spring force 204 is opposed by the horizontal (axial) component 208 of the force 202 applied by the roller 166 to the edge 176 at the instant the roller lifts off the edge 177 therebelow. Below the calibrated setting for the wrench the horizontal component 208 is distributed against both edges 176 and 177.

The vertical (normal) component 210 of the force 202 is proportional to the torque being applied to the wrench. The angular position $\theta$ of the force 202 is determined by the slot 170 width between the edges 176 and 177 and the diameter of the roller 166. To assure that the roller 166 rolls out of the slot 170 about the edge 176 at the calibrated setting, the slot width and roller diameter are selected to assure that $\theta$ is less than 45°. However, to minimize the spring force 204 necessary and thereby prolong the life of the wrench by minimizing wear on the roller 166 and edges 176 and 174, the angle $\theta$ is not significantly below 45°. Rather, the slot width and roller diameter are selected to place $\theta$ as close as 45° as is practical without exceeding the 45° maximum limitation.

Opposing the force 202 applied to the sliding member 150 at the edge 176 are the aforementioned spring force 204 and the reaction force 212 applied by the inside wall of the main body 120 diametrically opposite roller 166. Preferably, the force 212 is a substantially evenly distributed force as shown and may be representative as the normal component **212*a* of a force 200 opposed to the force 202, the axial component of force 200 being spring force 204**.

As is apparent, the forces on the sliding member 150 are in equilibrium, however, the normal component 210 tends to cock the sliding member 150 clockwise within the sliding clearance necessary for movement of the sliding member inside the tubular main body 120. This cocking torque or couple, if not opposed, destroys the smooth distribution of the reaction force 212 causing the entire force 212 to be applied at 213. The concentrated force at 213 causes the sliding member 150 to abrade the main body 120 and reduces the repeatable accuracy of the wrench thus requiring the use of steel main bodies for the wrench of FIGS. 1 through 4 and some of the prior art wrenches cited above.

In the wrench of FIGS. 5 through 8, however, the roller 166, being offset from the wrench axis 206, applies a counterclockwise torque or couple to the sliding member 150 in opposition to the cocking torque. The counterclockwise torque is created by the spring force 204 and horizontal force component 208, the latter being diametrically opposite the taper 172 and point 213. The counterclockwise torque substantially eliminates the cocking torque on the sliding member 150.

At torque levels below the preset torque level (calibration bolt setting), the axial components of the forces increase in proportion to increases in the radial components. Thus, the couples continue to balance each other as the torque applied to the wrench increases and cocking of the sliding member is substantially prevented. At the preset torque level the sliding member 150 slides to the right and the click arm moves upward sharply. The taper, 172, upon striking the inside of the main body 120, acts as a limit or stop to prevent the roller 166 from rolling into an over center position. With release of the torque on the wrench, the click arm moves back into the position shown in FIG. 8 and the sliding member moves back to the left. By eliminating the tendency to cock, the abrasion and gouging of the inside of the wrench body by the sliding member is substantially eliminated and the friction opposing the movement of the sliding member reduced. The reduction in the friction opposing the movement of the sliding member and the substantial elimination of the cocking improves the accuracy of the initial torque setting of the wrench and the retention of the torque setting after repeated use.

Figure 9:
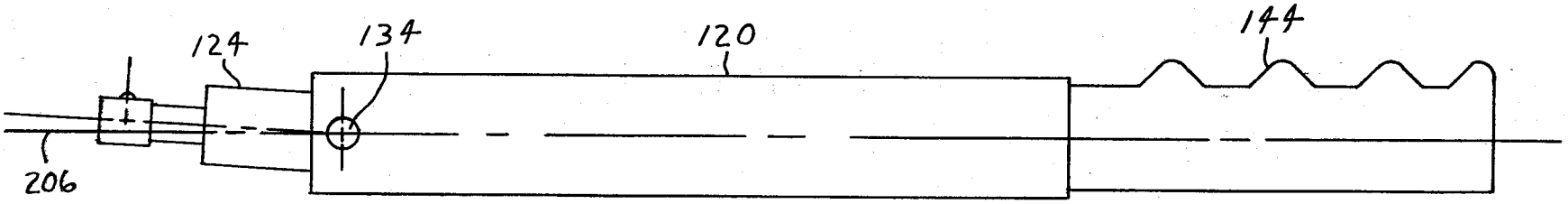
FIG. 9 is an external side view of the wrench of FIG. 5.
Figure 10:
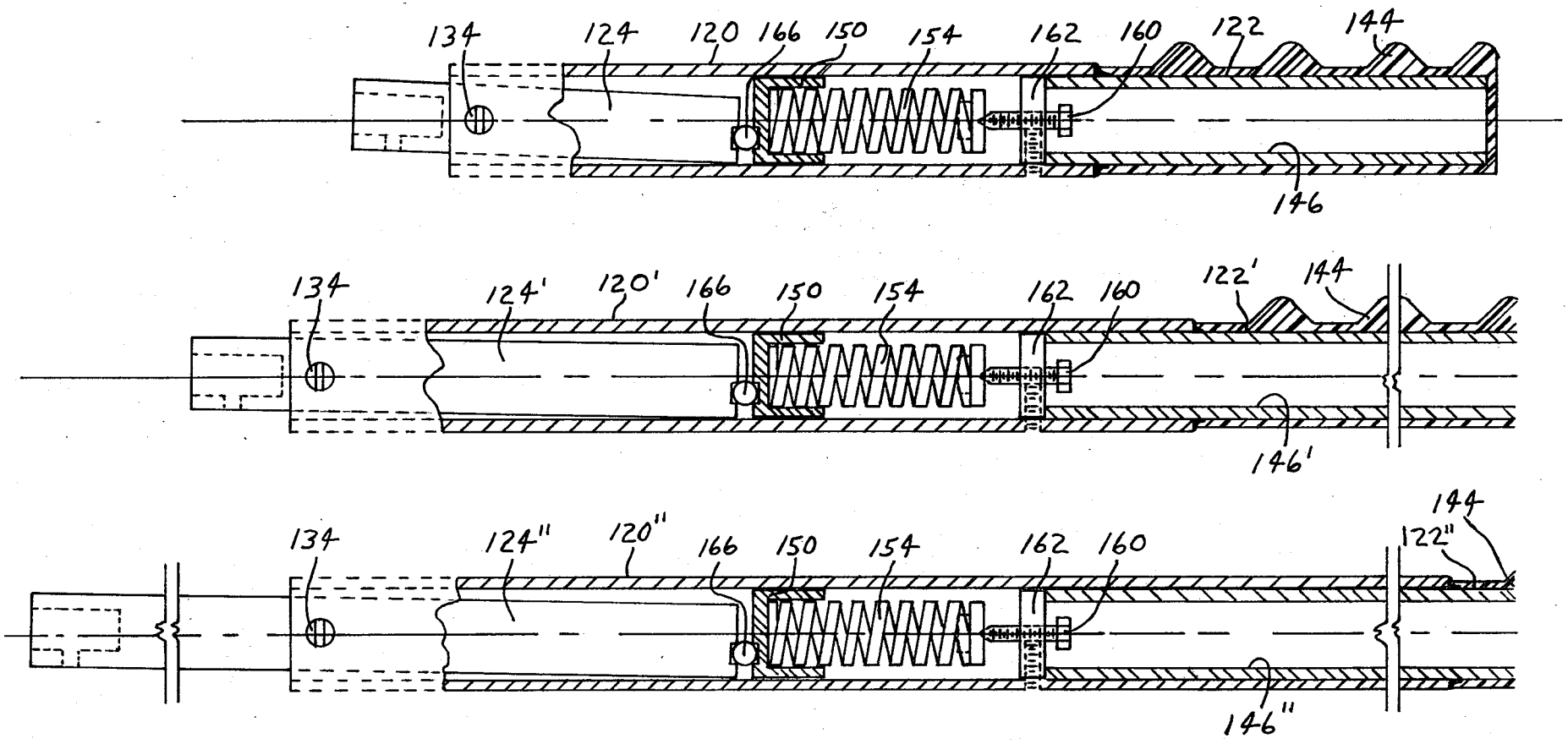
FIG. 10 illustrates with triple cutaway longitudinal side views the relationship among a family of wrenches having differing torque ranges.

FIG. 9 illustrates the external appearance of the wrench of FIG. 5. In comparison with the wrench of FIG. 1 the click arm 124 is angled slightly from the centerline 206 of the wrench in the unactuated position shown. As a result the taper 172 required is minimized thus reducing manufacturing cost for the wrench. Referring to FIG. 10 a family of wrenches incorporating the internal configuration of FIG. 5 and the external appearance of FIG. 9 is illustrated.

In FIG. 10 as shown each of the family of wrenches utilizes the same internal parts, i.e., spring 154, sliding member 150, roller 166, calibration bolt 160 and thrust plate 162. The change in range of torque levels is accomplished by, firstly, changing the length of the wrench body 120 to 120' or 120" and the handle 122 to 122' or 122". The internal portion of the click arm 124 between the roller 166 and the pivot pin 134 is also extended as shown by 124' and 124" inside the wrench bodies 120' and 120". Secondly, the click arm 124" is extended leftward from pin 134 outside the body 120" a distance substantially greater than that of the other two wrenches shown in FIG. 10. The grips 144 on the handle 122' or the handle 122" are located at increasing distances from the thrust plate 162 in comparison with handle 122. This is accomplished by extending the bodies 120' and 120" to the right as shown and lengthening the tubes 146' and 146" to provide a greater overlap with the respective bodies as shown.

A suitable construction of the wrenches is as follows. The internal parts may be constructed as shown in FIGS. 1 through 4 or as shown in FIGS. 5 through 8. In the former case the roller in $\frac{3}{8}$ inches in diameter and $\frac{1}{2}$ inches long. The slots are 1/16 inches in depth, $\frac{1}{4}$ inches wide and extend diametrically across a sliding member $\frac{7}{8}$ inches in diameter and a click arm $\frac{3}{4}$ inches in diameter. In the latter case the roller is $\frac{1}{4}$ inches in diameter and $\frac{1}{2}$ inches long with slots 1/32 inches in depth and 5/32 inches wide extending across the sliding member and click arm centered about a chord 3/16 inches from the axis of the wrench and parallel with pin 134 axis. In the latter case the end wall thickness of the sliding member is 9/64 inches.

The length of the body and click arm is determined by the particular torque range desired. A 10–10 foot-pound wrench utilizes a main body 7 inches in length and a click arm $2\frac{3}{8}$ inches from roller to pivot pin axis. The click arm extends another $1\frac{1}{4}$ inches beyond the pivot pin axis. A family of wrenches having torque ranges of 5–25, 10–50 and 40–150 foot-pounds has been developed corresponding to the three wrenches illustrated in FIG. 10. 30–100 and 50–200 foot-pound wrenches utilizing the main body of the bottom which shown in FIG. 10 are also included in the family of wrenches. All of the wrenches utilize a 230 pound maximum spring force at the higher limit of the torque range for each wrench, a force believed substantially less than that of other wrenches currently in use and contributing to the exceptionally long life and reduced wear on internal parts with applicant's wrenches.

We claim:

1. A torque wrench comprising a generally tubular body having a handle at one end and a click arm extending from the other end, the click arm being pivotally attached within the tubular body, a slot in the end of the click arm inside the tubular body forming a pair of engageable edges parallel to the pivot axis of the click arm, a slideable member inside the tubular body, a slot in one end thereof forming a second pair of engageable edges parallel to the pivot axis of the click arm and opposed to the click arm, a free floating circular roller having the axis thereof parallel to the pivot axis of the click arm and having the round side thereof in engagement with each of the aforesaid edges in the unactuated position, said roller spaced from the bottom of each of said slots and separating the click arm from the slideable member, means within the tubular body engaging the slideable member and urging the slideable member into engagement with the roller, said means including adjustment means to determine the force applied by the slideable member against the roller and click arm.

2. The torque wrench of claim 1 wherein the axis of the roller in the unactuated position is spaced from the centerline of the wrench body in a direction substantially opposite the direction of movement of the click arm engageable edge upon actuation.

3. The torque wrench of claim 1 wherein the engageable edges and roller axis are spaced from the wrench body axis a distance sufficient to cause force components parallel to the wrench body axis to apply a torque couple on the slideable member substantially equal to and in opposition to the torque couple on the slideable member caused by force components perpendicular to the wrench body axis.

4. The torque wrench of claim 1 wherein the engageable edges and roller axis are spaced from the wrench body a distance sufficient to apply a torque couple on the slideable member in opposition to the torque couple on the slideable member applied by the wrench body and roller.

5. The torque wrench of claims 2, 3 or 4 wherein the tubular body comprises a material light in weight relative to steel.

6. The torque wrench of claim 5 wherein the tubular body comprises an aluminum alloy material.

7. The torque wrench of claims 2, 3 or 4 including a threaded pivot pin at the pivot axis attaching the click arm to the tubular body.

8. The torque wrench of claims 2, 3 or 4 wherein the slideable member include a cup shaped pocket and wherein a spring engaged in the pocket urges the slideable member into engagement with the roller.

9. A family of torque wrenches constructed as claimed in claims 1, 2, 3 or 4 wherein the operable range of torque level of each wrench is determined by the length of the click arm from roller engageable edge to pivotal attachment, the overall length of the click arm and the length of the tubular body from the pivotal attachment to the handle, the range of force applied to the slideable member corresponding to each torque range being substantially identical for all wrenches of the family.

10. A torque wrench comprising a generally tubular body having a handle at one end and a click arm extending from the other end, the click arm being pivotally attached within the tubular body, a first slot formed in the end of the click arm inside the tubular body, a slideable member inside the tubular body and having a second slot formed in one end thereof opposed to the first slot, a free floating circular roller having a diameter greater than the width of either slot and having the round side thereof engaging the click arm and the slideable member on both edges of each slot in the unactuated position, said roller spaced from the bottom of each slot, a spring within the tubular body engaging the other end of the slideable member, the spring urging the slideable member toward the click arm, torque adjustment means within the tubular body engaging the spring, the force applied by the spring on the slideable member being determined by the setting of the torque adjustment means, and, the roller axis and slots being transverse to the tubular body and parallel to the click arm pivot axis.

11. The torque wrench of claim 10 wherein the axis of the roller in the unactuated position intersects the centerline of the tubular body.

12. The torque wrench of claim 10 wherein the axis of the roller in the unactuated position is displaced from the centerline of the tubular body.

13. The torque wrench of claim 12 wherein the spring engages the slideable member within a cup shaped pocket formed in the slideable member.

14. The torque wrench of claim 12 wherein the tubular body comprises a material light in weight relative to steel.

15. The torque wrench of claim 10 including a threaded pivot pin at the pivot axis attaching the click arm to the tubular body.

* * * * *

UNITED STATES PATENT AND TRADEMARK OFFICE

CERTIFICATE OF CORRECTION

PATENT NO. : 4,403,531

DATED : September 13, 1983

INVENTOR(S) : Roy E. Bailey, Ben J. Bailey

It is certified that error appears in the above-identified patent and that said Letters Patent are hereby corrected as shown below:

Column 2, line 42, "of" should read -- or --.

Column 3, line 41, "clock" should read -- click --.

Column 4, line 60, "representative" should read --represented --

Column 6, line 16, "10-10" should read -- 10-50 --.

Column 6, line 24, "which" should read -- wrench --.

Column 7, line 19, "include" should read -- includes --.

Signed and Sealed this

*Twenty-second* Day of *November 1983*

[SEAL]

*Attest:*

GERALD J. MOSSINGHOFF

*Attesting Officer*

*Commissioner of Patents and Trademarks*